United States Patent [19]

Luiki

[11] Patent Number: 4,974,463

[45] Date of Patent: Dec. 4, 1990

[54] STARTING MOTOR WITH A TRANSLATABLE IDLER/PINION GEAR

[75] Inventor: Paul Luiki, Northville, Mich.

[73] Assignee: Ford Motor Company, Dearborn, Mich.

[21] Appl. No.: 288,388

[22] Filed: Dec. 22, 1988

[51] Int. Cl.[5] ..... F02N 11/00

[52] U.S. Cl. ..... 74/7A; 74/7 E; 74/7 R

[58] Field of Search ..... 74/7 A, 7 E, 7 R, 6; 290/48

[56] References Cited

U.S. PATENT DOCUMENTS

| | | | |
|---|---|---|---|
| 1,156,869 | 10/1915 | Walker . | |
| 1,274,371 | 8/1918 | Bendix | 290/48 |
| 1,441,418 | 1/1925 | Halbleib . | |
| 1,916,173 | 6/1933 | Lansing . | |
| 4,356,735 | 11/1982 | Bögner et al. | 74/7 A |
| 4,440,033 | 4/1984 | Kurihara et al. | 74/7 A |
| 4,510,406 | 4/1985 | Morishita | 310/99 |
| 4,525,632 | 6/1985 | Tanaka | 290/38 R |
| 4,590,811 | 5/1986 | Kasubuchi | 74/7 E |
| 4,592,243 | 6/1986 | Katoh et al. | 74/7 E |

FOREIGN PATENT DOCUMENTS

| | | | |
|---|---|---|---|
| 642827 | 6/1962 | Canada | 74/7 A |
| 2076238 | 10/1971 | France . | |
| 176114 | 2/1922 | United Kingdom | 74/7 E |

*Primary Examiner*—Kenneth J. Dorner
*Assistant Examiner*—Brian K. Green
*Attorney, Agent, or Firm*—Paul K. Godwin, Jr.; Clifford L. Sadler

[57] ABSTRACT

A starter motor for use with an internal combustion engine, which incorporates an idler gear that is constantly engaged with a translatable pinion gear to provide starting engagement and rotation to a driven gear on the engine.

1 Claim, 2 Drawing Sheets

STARTING MOTOR WITH A TRANSLATABLE IDLER/PINION GEAR

BACKGROUND OF THE INVENTION

1. Field of the Invention

The present invention is directed to the field of starter motors for internal combustion engines and more specifically to the area of the engageable gearing that interconnects the starter motor to the engine.

2. Description of the Prior Art

Conventionally, as shown in U.S. Pat. Nos. 4,356,735; 4,510,406; 4,525,632; and 4,590,811, electrical starter motors for use within internal combustion engines normally employ a solenoid actuatable pinion gear which slides along a rotationally driven output shaft to engage a driven gear of the engine. Upon engagement of the driven gear, the motor portion is energized and the pinion gear is driven rotationally through a pinion clutch mechanism to rotate the driven gear and start the engine. As can be seen from the above-noted patents, the packaging of the starter motor is such that a portion of the starter motor housing contains an open area whereby the driven gear extends into the housing so that the pinion gear may be slidably engaged therewith.

SUMMARY OF THE INVENTION

Recently, because of reduced clearances available for installation of starter motors on engines, there is a need for flexibility in such mountings. In the case of the associated engine for which the present invention was made, a conventional starter motor could not be placed in a location on the engine that would allow the driven gear of the engine to protrude into the housing and be engaged by the pinion gear. The present invention was made to allow for the substantial incorporation of a conventional starter motor in a situation where it is desired to establish communication between a slidable pinion gear and a driven engine gear when mounting limitations prevent direct engagement. That is achieved by use of a translatable idler gear that moves with the pinion gear and makes the actual engagement with the driven gear.

It is, therefore, an object of the present invention to provide a starter motor for an engine in which the slidable pinion gear communicates its rotational drive to an associated engine through an idler gear which translates in tandem with the pinion gear to engage a driven gear of the engine.

It is another object of the present invention to provide an idler gear that is slidably moved into and out of engagement with the driven gear as a result of its translating engagement with the pinion clutch.

DETAILED DESCRIPTION OF THE PREFERRED EMBODIMENT

Figure 1:
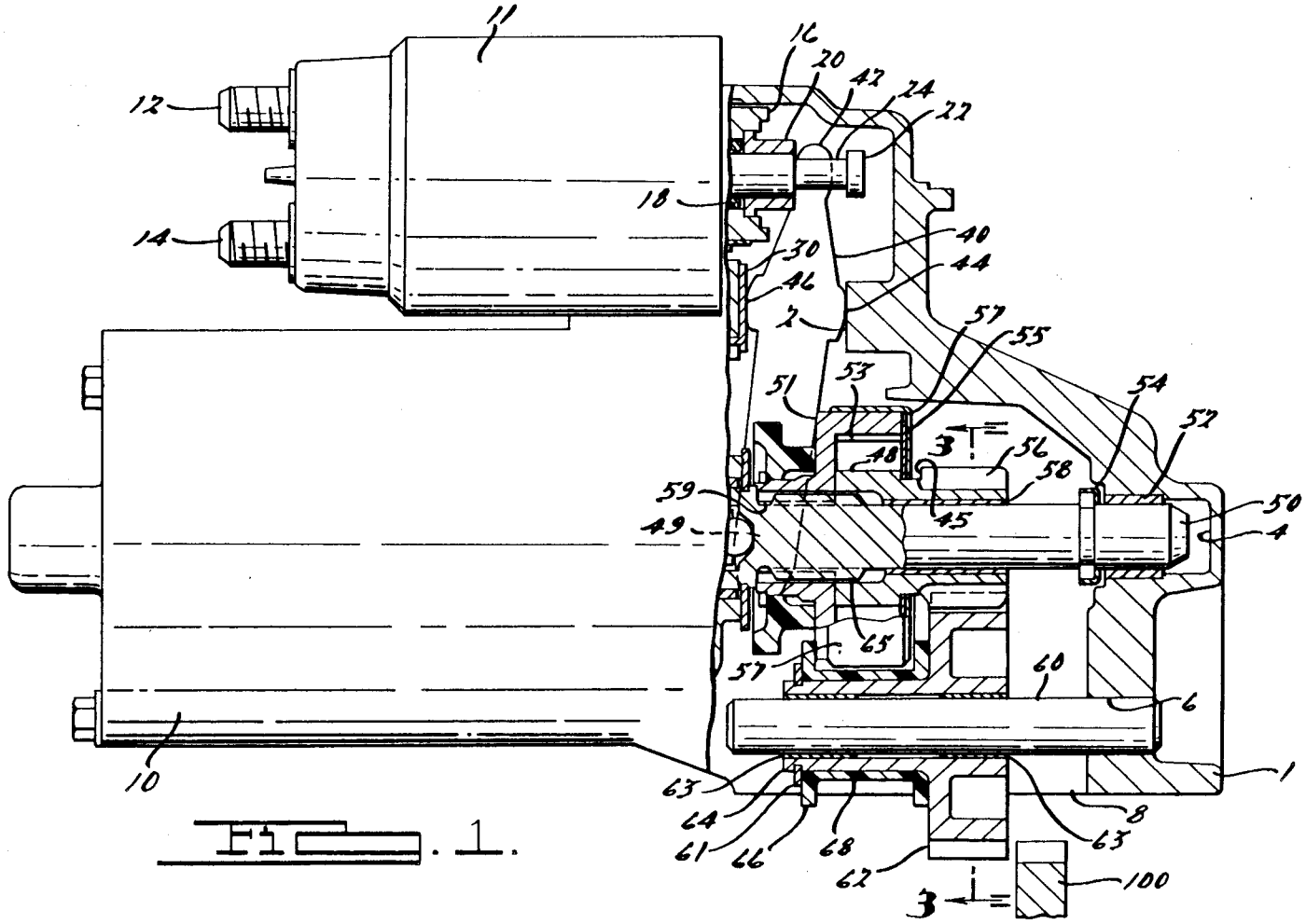
FIG. 1 is an elevational plan view of a starter motor which illustrates the present invention in its disengaged state with respect to the driven gear.

In FIG. 1, the starter motor 10 embodies the present invention and is shown in its deenergized state. In that state, a driven gear 100 extending from an internal combustion engine (not shown) is not engaged by the starter motor 10. The driven gear 100 is normally part of a flywheel within the associated internal combustion engine and becomes engaged by the starter motor and driven thereby during the starting sequence of the engine.

As discussed above in the Summary of the Invention section, prior art starter motors included pinion gears such as 56 that were engageable with the driven gear 100. However, as can be seen in FIG. 1, the mounting position of the motor 10 is such that significant spacing in that area would prevent the pinion gear 56 from engaging the driven gear 100.

The present invention provides an idler gear 62 between the pinion gear 56 and the driven gear 100 to overcome that spacing problem. The following discussion details the preferred mechanism that allows the idler gear 62 to move into and out of engagement with the driven gear 100 in response to both linear and rotational movement applied to the pinion gear 56.

A starter drive end housing 1 is fixedly connected to the housing of the motor 10 and provides support for the various movable elements therein. A socket 4 formed in the end housing 1 provides a seat for bearing 52. The bearing 52 allows rotation of a starter output shaft 50 mounted therein. The starter output shaft 50 is connected in a conventional manner to a planetary gear drive mechanism (not shown) within the housing of the motor 10. The electric motor portion (not shown) is also within the housing and provides the rotary drive directly to the planetary gear drive mechanism and the starter output shaft 50 which rotates about its longitudinal axis. The starter output shaft 50 contains a set of external spline teeth 65 at the end opposite the bearing 52 and also contains a retaining ring 54 adjacent the bearing 52.

A bearing 58 surrounds the portion of the output shaft 50 between the spline teeth 65 and the retaining ring 54. The bearing 58 is retained within the starter drive pinion gear 56 so as to allow low friction sliding motion of the pinion gear 56 along the output shaft 50. The pinion gear 56 also contains a circumferential groove 45 between a shank portion 48 and the teeth of the pinion gear 56. An overrunning clutch 51 contains a washer 55 which is captured within the groove 45 of the pinion gear 56 and a set of friction rollers 53 that are spring loaded in a conventional manner to bear on the shank 48 and force rotation of the pinion gear 56 in one direction only. The overrunning clutch 51 further contains a metal seal 57 and internal teeth 59 that mate with the spline teeth 65 on the output shaft 50.

Figure 3:
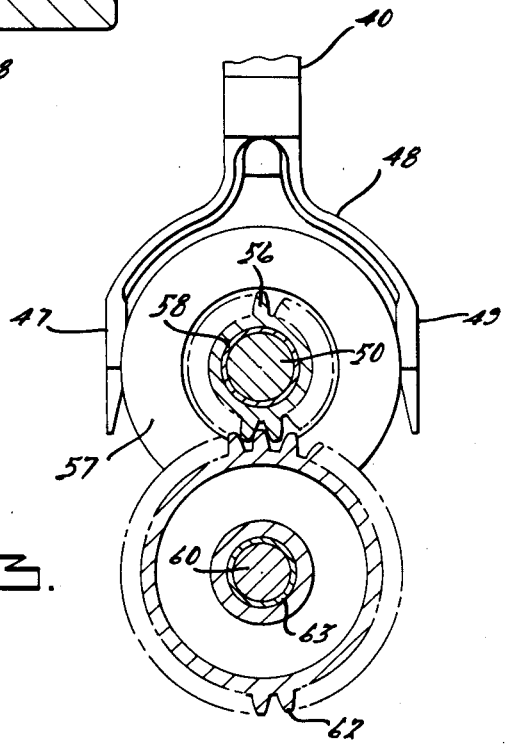
FIG. 3 is a cross-sectional view of the present invention taken along section line 3—3 in FIG. 1.

The clutch 51 and the pinion gear 56 are controllably positioned along the shaft 50 by the movement of a lever 40 which is connected to the clutch 51 (see FIG. 3).

Figure 2:
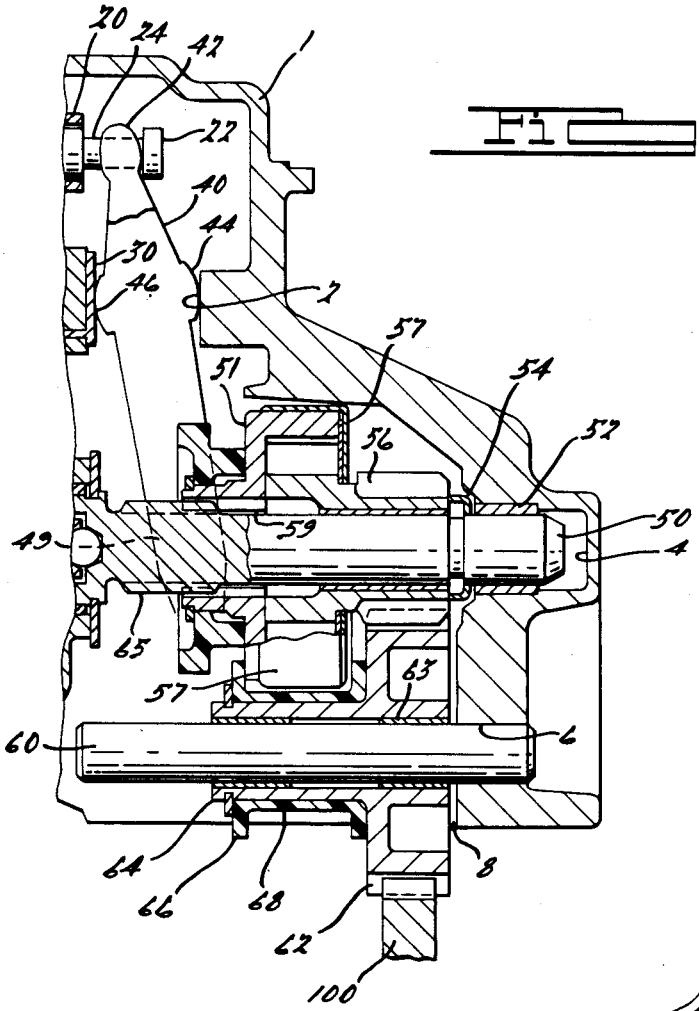
FIG. 2 illustrates the partial cross section portion of FIG. 1 with the present invention in its engaged state with respect to the driven gear.

The starter motor 10 is shown with an associated solenoid actuator 11 containing electrical terminal posts 12 and 14. The lever 40 is pivotally retained within the housing for actuation by the solenoid 11. The solenoid 11 contains a plunger 16 which is spring biased outwardly when the solenoid 11 is deenergized (FIG. 1) and is retracted inward by the energization of the solenoid 11 (FIG. 2). A cavity within the plunger 16 contains a spring 18 which biases a ring 20 outwardly on a pin 24. Pin 24 contains a stop 22 formed at its outer end and the upper portion of the lever 40 is positioned to be captured between the ring 20 and the stop 22 to move therewith when the plunger 16 is moved between its first and second positions, as shown respectively in FIG. 1 and 2. The pivotal cam portions 44 and 46 of the lever 40 rest against parallel surfaces 2 and 30.

The idler gear 62 is mounted with sliding bearings 63 on a stationary pin 60 which is staked in an aperture 6 formed in the housing 1. The pin 60 is mounted substantially parallel to the axis of the rotatable shaft 50 so that the idler gear 62 will translate in the same direction as, and along with, the idler gear 56. The idler gear 62 contains an extended shank 64 on to which a double flanged sleeve 66 is retained by spring clip 61. The double flanged sleeve 66 contains a recessed portion 68 positioned to receive a portion of the clutch 51 which extends outwardly beyond the dimensions of the pinion gear 56.

In FIG. 2, the assembly, including the present invention, is shown in its energized state whereby the idler gear 62 is engaged with the driven gear 100, ready to be rotationally driven by the output shaft 50/clutch 51/pinion gear 56 assembly. Of course, the idler gear 62 is translated into engagement with the driven gear 100 by the energization of the solenoid 11 which pulls the pin 24 and the top 42 of lever 40 to the left. That movement of the top 42 of the lever 40 causes the bottom portion 49 to move to the right and, therefore, translate the clutch 51/idler gear 56 along the rotatable shaft 50. Since the clutch 51 is engaged with the double flanged sleeve 66 on the idler gear 62, the idler gear 62 is translated along pin 60 into engagement with the driven gear 100. Upon deenergization of the solenoid 11, the idler gear will be translated back to its first position as shown in FIG. 1.

FIG. 3 illustrates the yoke 48 extending from the lever 40 so as to be pivotally connected at points 47 and 49 to the clutch 51. The pinion gear 56 is continuously engaged with the idler gear 62 and causes the idler gear 62 to counter rotate. Accordingly, after the idler gear 62 is translated into engagement with the driven gear 100, the rotation of the motor driven output shaft 50 will be communicated via spline gear teeth 65 to clutch 51, to pinion gear 56. The idler gear 62 is counter rotated with respect to pinion gear 56 and rotates the driven gear 100 in the same direction as the pinon gear 56.

As a result of the above-described invention, flexibility in mounting the starter motor 10 within the engine compartment is provided due to the separation provided by the translatable idler gear residing between the pinion gear 56 and the driven gear 100. Modification of a conventional starter motor with the present invention to achieve the desired advantages may also require that the direction of rotation for the motor be changed so that the proper drive direction can be output to the driven gear 100.

It is apparent that many modifications and variations may be implemented without departing from the scope of the novel concept of this present invention. Therefore, it is intended by the appended claims to cover all such modifications and variations which fall within the true spirit and scope of the invention.

I claim:

1. A starter motor for an engine having a driven gear comprising:

an electric motor;

an output shaft containing external spline teeth on a portion thereof mounted for rotation about its axis by said electric motor;

an overrunning clutch mounted on said output shaft in continuous engagement with said spline teeth;

a pinion gear connected to said clutch and mounted on said output shaft for rotation by said clutch and for slidable movement with said clutch parallel to the rotation axis of said output shaft;

means connected to said clutch for slidably moving said clutch and said pinion gear along said output shaft;

a stationary pin mounted parallel to said output shaft;

an idler gear slidably mounted on said stationary pin, having gear teeth continuously engaged with those of said pinion gear and also having an ungeared portion continuously engaged with said clutch, for slidable movement therewith along said pin into gear mesh engagement with said driven gear for rotational movement with respect to said pin in direct response to the rotational movement of said pinion gear.

* * * * *